US008831479B2

(12) United States Patent
Arikawa et al.

(10) Patent No.: US 8,831,479 B2
(45) Date of Patent: Sep. 9, 2014

(54) UNIT MOUNTING AND DISMOUNTING MECHANISM, MOUNTING AND DISMOUNTING MECHANISM FOR FIXING UNIT, AND IMAGE FORMING APPARATUS

(75) Inventors: Kiichirou Arikawa, Kanagawa (JP); Masami Ishida, Kanagawa (JP); Shigeru Watanabe, Kanagawa (JP); Yoshiro Konishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 258 days.

(21) Appl. No.: 13/372,166

(22) Filed: Feb. 13, 2012

(65) Prior Publication Data

US 2013/0077993 A1 Mar. 28, 2013

(30) Foreign Application Priority Data

Sep. 27, 2011 (JP) ..... 2011-211567

(51) Int. Cl.
*G03G 15/16* (2006.01)
*G03G 21/16* (2006.01)

(52) U.S. Cl.
CPC .... *G03G 21/1685* (2013.01); *G03G 2221/1654* (2013.01); *G03G 21/1647* (2013.01)
USPC ..... 399/122; 399/110; 399/111; 399/113; 399/107

(58) Field of Classification Search
USPC ..... 399/110, 111, 113, 107
See application file for complete search history.

(56) References Cited

U.S. PATENT DOCUMENTS 5,579,098 A * 11/1996 Noguchi et al. ..... 399/122
6,314,256 B1 * 11/2001 Saitoh ..... 399/122

FOREIGN PATENT DOCUMENTS

JP 08-179673 A 7/1996
JP 2009-216912 A 9/2009

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

A unit mounting and dismounting mechanism includes a unit mountable in and dismountable from an apparatus body, an engaging portion provided in one of the apparatus body and the unit, a pressing member provided in the other of the apparatus body and the unit, the pressing member engaging with the engaging portion and pressing the unit against the apparatus body with a biasing force of a biasing member in a mounting direction of the unit when the unit is mounted in the apparatus body, and a release member provided in the unit, the release member being operated in a direction different from a dismounting direction of the unit from the apparatus body so as to move the pressing member against the biasing force of the biasing member in a direction to release pressing.

8 Claims, 12 Drawing Sheets

UNIT MOUNTING AND DISMOUNTING MECHANISM, MOUNTING AND DISMOUNTING MECHANISM FOR FIXING UNIT, AND IMAGE FORMING APPARATUS

CROSS-REFERENCE TO RELATED APPLICATIONS

This application is based on and claims priority under 35 USC 119 from Japanese Patent Application No. 2011-211567 filed Sep. 27, 2011.

BACKGROUND

(i) Technical Field

The present invention relates to a unit mounting and dismounting mechanism, a mounting and dismounting mechanism for a fixing unit, and an image forming apparatus.

SUMMARY

According to an aspect of the invention, there is provided a unit mounting and dismounting mechanism including: a unit mountable in and dismountable from an apparatus body; an engaging portion provided in one of the apparatus body and the unit; a pressing member provided in the other of the apparatus body and the unit, the pressing member engaging with the engaging portion and pressing the unit against the apparatus body with a biasing force of a biasing member in a mounting direction of the unit when the unit is mounted in the apparatus body; and a release member provided in the unit, the release member being operated in a direction different from a dismounting direction of the unit from the apparatus body so as to move the pressing member against the biasing force of the biasing member in a direction to release pressing.

BRIEF DESCRIPTION OF THE DRAWINGS

Exemplary embodiment(s) of the present invention will be described in detail based on the following figures, wherein.

DETAILED DESCRIPTION

A unit mounting and dismounting mechanism, a mounting and dismounting mechanism for a fixing unit, and an image forming apparatus according to an exemplary embodiment of the present invention will be described.

Overall Configuration

Figure 1:
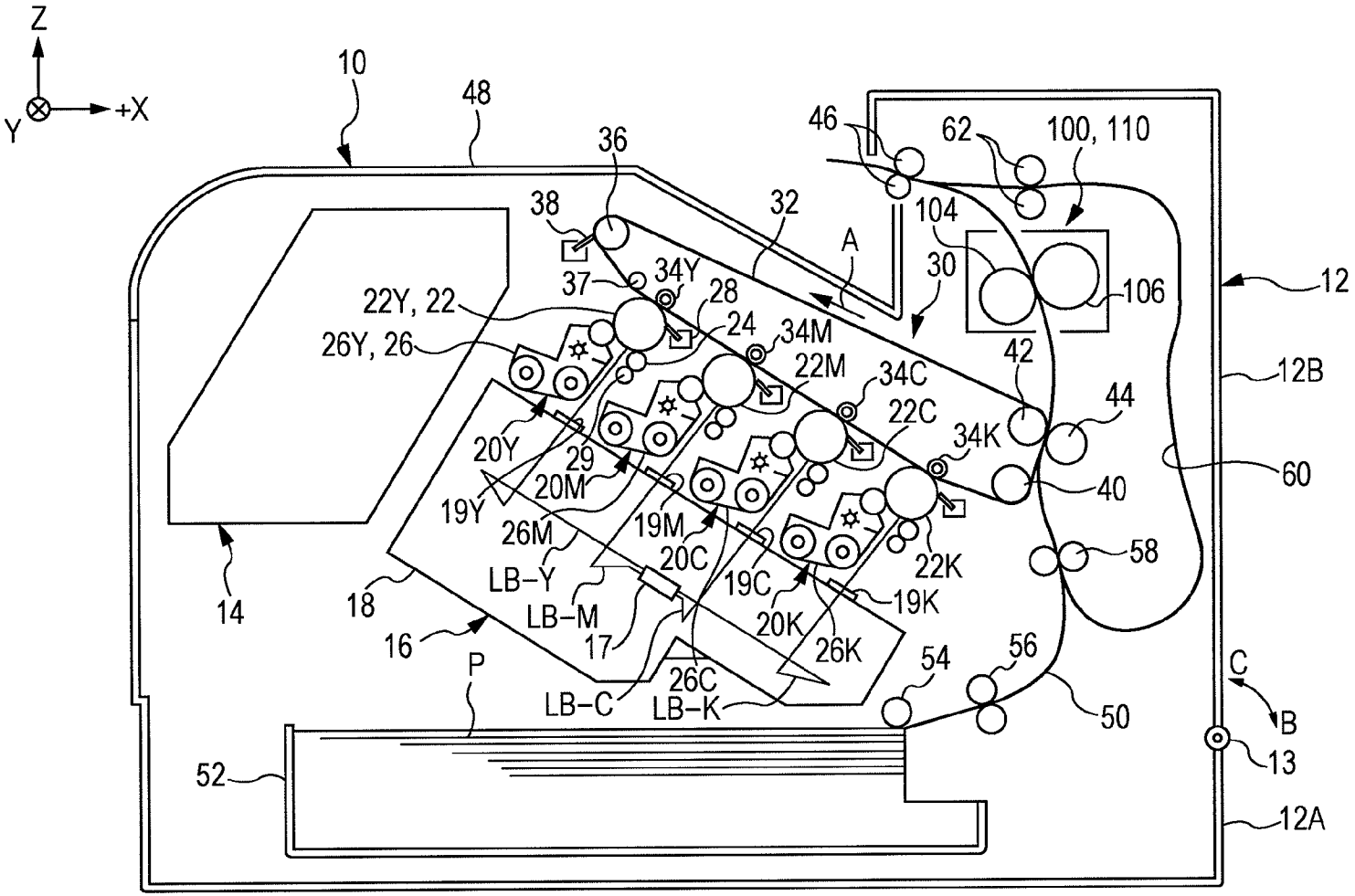
FIG. 1 illustrates an overall, configuration of an image forming apparatus according to an exemplary embodiment of the present invention.

FIG. 1 illustrates an image forming apparatus 10 according to the exemplary embodiment. The image forming apparatus 10 has a housing 12 including a body section 12A and a cover section 12B. The body section 12A serves as an example of an apparatus body that stores units and members from a sheet storage portion 52 to output rollers 46 that will be described. The cover section 12B is connected to the body section 12A by a hinge member 13. By moving the cover section 12B in an arc form in a direction of arrow B (clockwise direction in the figure), a below-described fixing unit 100 is exposed.

The body section 12A and the cover section 12B of the housing 12 are combined to form a box by moving the cover section 12B in an arc form in a direction of arrow C (counterclockwise direction in the figure). In the housing 12, an image processing unit 14 is provided to conduct image processing on input image data.

In the following description, a Y-direction represents a depth direction of the housing 12 (a direction along an axial direction of below-described photoconductors 22), an X-direction represents a horizontal direction orthogonal to the Y-direction, and a Z-direction represents a vertical direction orthogonal to the X-direction and the Y-direction. A +X-direction represents a dismounting direction in which the below-described fixing unit 100 is dismounted from the body section 12A, and a −X-direction represents a mounting direction in which the fixing unit 100 is mounted into the body section 12A.

The image processing unit 14 processes input image data into gradation data of four colors of yellow (Y), magenta (M), cyan (C), and black (K). According to the gradation data processed by the image processing unit 14, an exposure device 16 provided in the center of the housing 12 performs image exposure with laser light beams LB.

The exposure device 16 includes four semiconductor lasers (not illustrated) having a common structure and corresponding to four image forming units 20Y, 20M, 20C, and 20K (described in detail below). The semiconductor lasers emit laser light beams LB-Y, LB-M, LB-C, and LB-K according to the gradation data.

The laser light beams LB-Y, LB-M, LB-C, and LB-K emitted from the semiconductor lasers are applied onto a polygonal mirror 17 serving as a rotating polygonal mirror through a cylindrical lens (not illustrated), and are deflectively scanned by the polygonal mirror 17. The laser light beams LB-Y, LB-M, LB-C, and LB-K defectively scanned by the polygonal mirror 17 are each scanned from an obliquely lower side to expose an exposure point on a corresponding photoconductor 22 (described in detail below) through an imaging lens and plural mirrors (not illustrated).

The exposure device 16 is enclosed by a frame 18 shaped like a rectangular parallelepiped. On an upper side of the frame 18, transparent glass windows 19Y, 19M, 19C, and 19K are provided to transmit the four laser light beams LB-Y, LB-M, LB-C, and LB-K onto photoconductors 22 (22Y, 22M, 22C, and 22K) in the image forming units 20Y, 20M, 20C, and 20K, respectively.

Above the exposure device 16, four image forming units 20Y, 20M, 20C, and 20K corresponding to yellow (Y), magenta (M), cyan (C), and black (K) are provided as an example of a developer-image forming unit. The image forming units 20Y, 20M, 20C, and 20K are arranged at intervals in a direction inclined with respect to the horizontal direction. When there is no need to distinguish among the colors Y, M, C, and K, the indexes Y, M, C, and K written after the reference numerals are sometimes omitted.

The image forming units 20Y, 20M, 20C, and 20K are similar in structure except in toner (developer) to be used. Each of the image forming units 20Y, 20M, 20C, and 20K includes a columnar photoconductor 22, a charging roller 24, a developing device 26, and a cleaning blade 28. The photoconductor 22 is rotated at a predetermined speed. The charging roller 24 charges an outer peripheral surface of the photoconductor 22. The developing device 26 develops an electrostatic latent image, which is formed on the charged outer peripheral surface of the photoconductor 22 by image exposure with the exposure device 16, with toner of a predetermined color into a visible toner image (developer image). The cleaning blade 28 cleans the outer peripheral surface of the photoconductor 22 after the toner image is transferred. On a lower side of the charging roller 24, a cleaning roller 29 is provided to clean an outer peripheral surface of the charging roller 24 by contact therewith.

A first transfer unit 30 serving as an example of a transfer unit is provided above the image forming units 20Y, 20M, 20C, and 20K.

The first transfer unit 30 includes an endless intermediate transfer belt 32, a driving roller 36, a tensioning roller 40, a driven roller 42, first transfer rollers 34Y, 34M, 34C, and 34K, and a support roller 37. The intermediate transfer belt 32 is wound on the driving roller 36, and the driving roller 36 rotates to circle the intermediate transfer belt 32 in a direction of arrow. The intermediate transfer belt 32 is also wound on the tensioning roller 40. The tensioning roller 40 applies tension to the intermediate transfer belt 32. The driven roller 42 is provided above the tensioning roller 40, and is rotated along with the rotation of the intermediate transfer belt 32. The first transfer rollers 34Y, 34M, 34C, and 34K are provided on a side of the intermediate transfer belt 32 opposite the photoconductors 22Y, 22M, 22C, and 22K. The support roller 37 is provided between the driving roller 36 and the first transfer roller 34Y to support a back surface of the intermediate transfer belt 32.

The four first transfer rollers 34Y, 34M, 34C, and 34K multiply transfer toner images of yellow (Y), magenta (M), cyan (C), and black (K), which are sequentially formed on the photoconductors 22 in the image forming units 20Y, 20M, 20C, and 20K, onto the intermediate transfer belt 32. Further, a cleaning blade 38 for cleaning an outer peripheral surface of the intermediate transfer belt 32 is provided on a side of the intermediate transfer belt 32 opposite the driving roller 36.

A second transfer roller 44 serving as an example of a transfer member is provided on a side of the intermediate transfer belt 32 opposite the driven roller 42. A voltage application unit (not illustrated) is connected to the second transfer roller 44 and the driven roller 42 so as to form a potential difference between the potential of the second transfer roller 44 and the potential of the driven roller 42. The toner images of yellow (Y), magenta (M), cyan (C), and black (K) multiply transferred on the intermediate transfer belt 32 are transported by the intermediate transfer belt 32, and are secondarily transferred onto a recording sheet (recording medium) P by the action of an electric field formed by the potential difference between the driven roller 42 and the second transfer roller 44. A sheet transport path 50 is provided in the housing 12. On the sheet transport path 50, a second transfer position is set as a contact portion between the intermediate transfer belt 32 and the second transfer roller 44.

A fixing unit 100 serving as an example of a unit is provided on a downstream side of the second transfer roller 44 in a transport direction of the recording sheet P (hereinafter simply referred to as a downstream side). The fixing unit 100 fixes the transferred toner images on the recording sheet P with heat and pressure. The fixing unit 100 will be described in detail below. On a downstream side of the fixing unit 100, output rollers 46 are provided to output the recording sheet P, on which the toner images are fixed, into an output portion 48 provided at the top of the housing 12 of the image forming apparatus 10.

A sheet storage portion 52 is provided in a lower part of the housing 12, and recording sheets P are stacked in the sheet storage portion 52. Above the sheet storage portion 52, a paper feed roller 54 is provided to feed the recording sheets P stacked in the sheet storage portion 52 into the sheet transport path 50. On a downstream side of the paper feed roller 54, separation rollers 56 are provided to separate and transport the recording sheets P one by one. On a downstream side of the separation rollers 56, registration rollers 58 are provided to determine the timing of transport of a recording sheet P to the second transfer position. With this structure, a recording sheet P transported from the sheet storage portion 52 is supplied to the second transfer position by the registration rollers 58 that rotate at a predetermined timing.

A duplex transport path 60 is connected between a position between the separation rollers 56 and the registration rollers 58 and a position between the fixing unit 100 and the output rollers 46 in the sheet transport path 50 so that image formation and fixing are conducted on both surfaces of the recording sheet P. Transport rollers 62 are provided next to the output rollers 46 on the duplex transport path 60. The transport rollers 62 transport a recording sheet P, on which a toner image is fixed on a front surface by the fixing unit 100, to the duplex transport path 60 without simply outputting the recording sheet P into the output portion 48 via the output rollers 46. Thus, the recording sheet P transported along the duplex transport path 60 is transported to the registration rollers 58 again while being turned upside down, and is output into the output portion 48 after a toner image is transferred and fixed on a back surface thereof.

Next, an image forming procedure performed in the image forming apparatus 10 will be described.

First, color gradation data are sequentially output from the image processing unit 14 to the exposure device 16, and the exposure device 16 emits laser light beams LB-Y, LB-M, LB-C, and LB-K according to the gradation data. The laser light beams LB-Y, LB-M, LB-C, and LB-K are scanned to expose the outer peripheral surfaces of the photoconductors 22 charged by the charging rollers 24, so that electrostatic latent images are formed on the outer peripheral surfaces of the photoconductors 22.

The electrostatic latent images formed on the photoconductors 22 are developed into visible toner images of yellow (Y), magenta (M), cyan (C), and black (K) by the developing devices 26Y, 26M, 26C, and 26K, respectively. These toner images are multiply transferred onto the circling intermediate transfer belt 32 by the first transfer rollers 34.

The color toner images multiply transferred on the circling intermediate transfer belt 32 are secondarily transferred by the second transfer roller 44 onto a recording sheet P that is transported to the second transfer position in the sheet transport path 50 at a predetermined timing by the registration rollers 58.

The recording sheet P on which the toner images are transferred is then transported to the fixing unit 100, where the transferred toner images are fixed on the recording sheet P. When an image is to be formed on only one surface, the recording sheet P is output by the output rollers 46 into the output portion 48 after the toner images are fixed.

In contrast, when images are to be formed on both surfaces of the recording sheet P, after toner images are fixed on the front surface of the recording sheet P by the fixing unit 100, the recording sheet P is not simply output to the output portion 48 by the output rollers 46, but is led into the duplex transport path 60 via the transport rollers 62 by switching the transport direction. When the recording sheet P is transported along the duplex transport path 60, it is turned upside down, and is transported to the registration rollers 58 again. Then, toner images are transferred and fixed onto a back surface of the recording sheet P similarly to the front surface, and the recording sheet P having the images on both surfaces is output into the output portion 48 by the output rollers 46.

Structure of Principal Part

Next, a mounting and dismounting mechanism 110 for the fixing unit 100 will be described as an example of a unit mounting and dismounting mechanism.

Figure 2A:
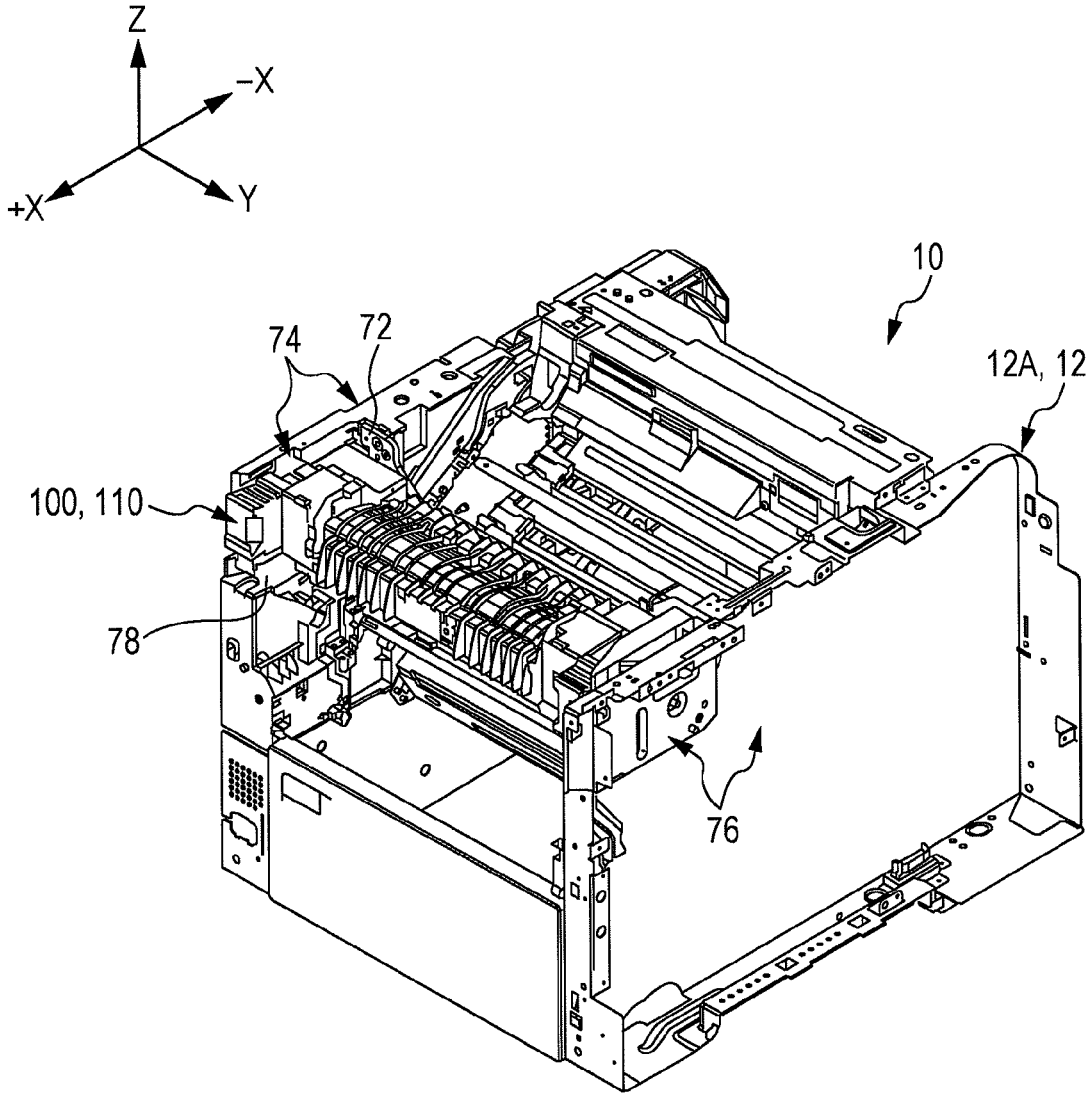
FIGS. 2A and 2B are perspective views illustrating states in which a fixing unit is mounted in and dismounted from a body section in the exemplary embodiment.
Figure 2B:
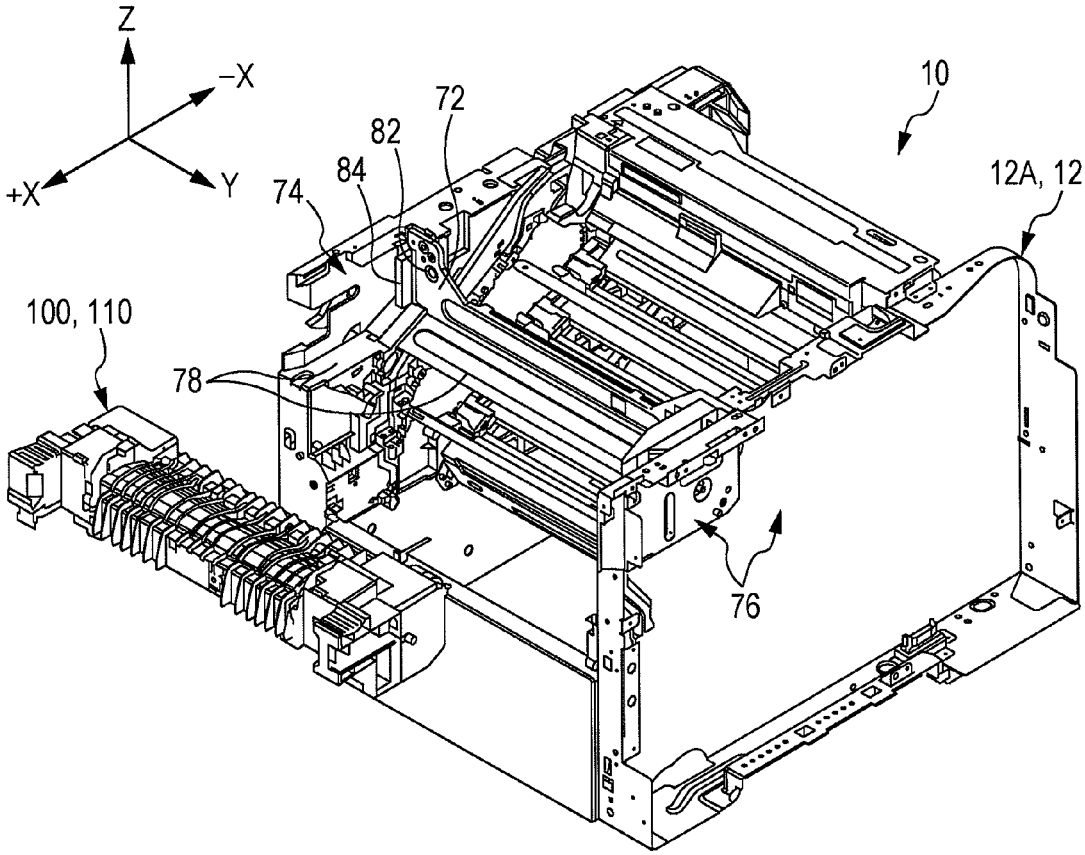

As illustrated in FIGS. 2A and 2B, the body section 12A of the housing 12 includes a positioning plate 72 standing upright to oppose a back surface of the fixing unit 100 (a front surface in the mounting direction (−X-direction)), side plates 74 and 76 standing upright at both ends of the positioning plate 74 in the Y-direction to support the positioning plate 72, and a guide plate 78 on which the fixing unit 100 is to be placed. The guide plate 78 hangs from a lower end of the positioning plate 72 in the +X-direction to guide movement of the fixing unit 100 in the −X-direction.

Figure 3:
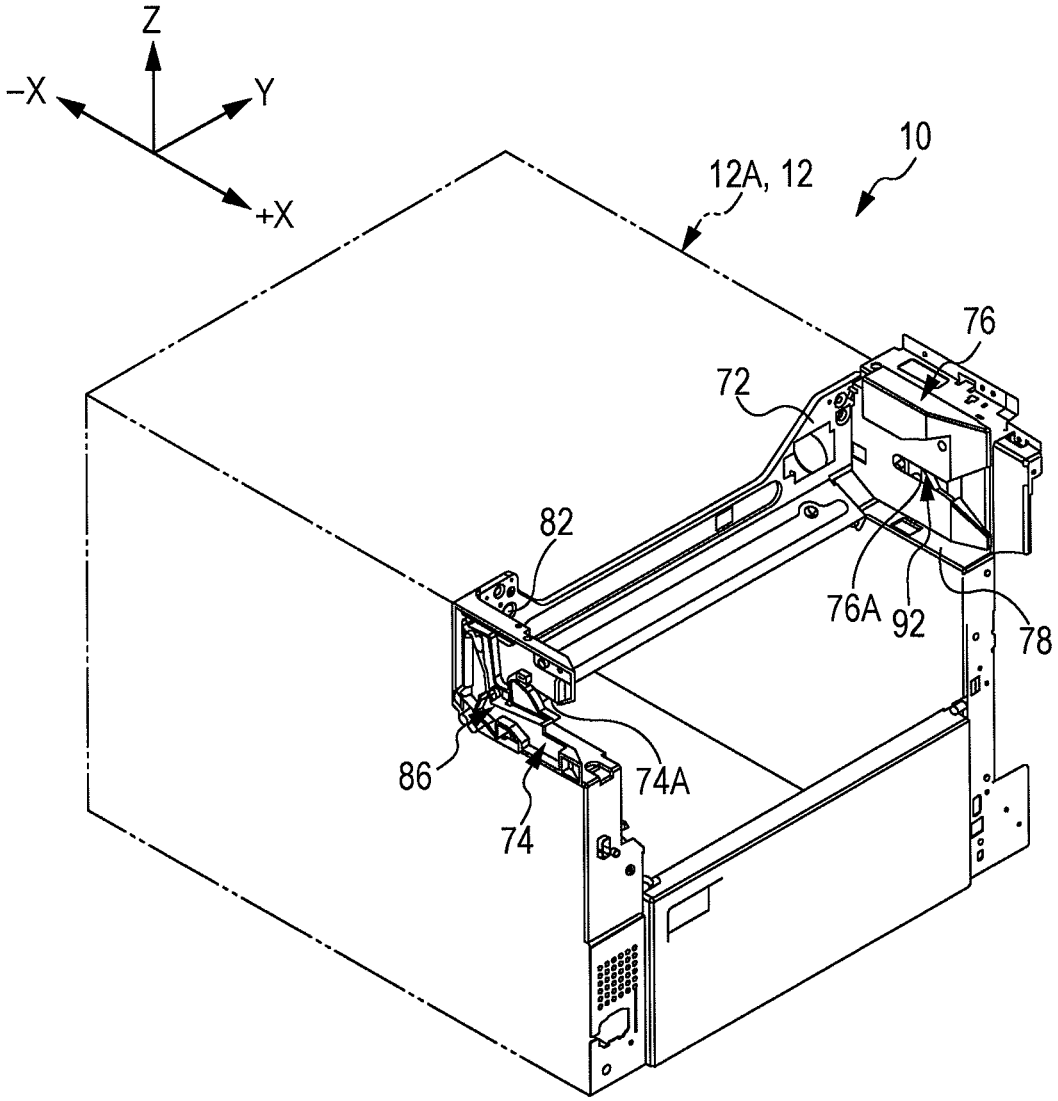
FIG. 3 is a perspective view of a positioning plate and side plate in the body section.

As illustrated in FIGS. 2B and 3, one end of the positioning plate 72 in the longitudinal direction (Y-direction)(a front side of the image forming apparatus 10) has a positioning hole 82 in which a below-described positioning pin 116 of the fixing unit 100 is to be inserted. As illustrated in FIG. 2B, a portion of the one end of the positioning plate 72 in the Y-direction adjacent to the positioning hole 82 has a connector 84 serving as an example of a connected portion projecting in the +X-direction.

The connector 84 is connected to a below-described connector portion 112 in the fixing unit 100 (see FIG. 6A) to supply electric power to a below-described halogen lamp 108 in the fixing unit 100 (see FIG. 6B) and to exchange signals with various sensors in the fixing unit 100.

Figure 4A:
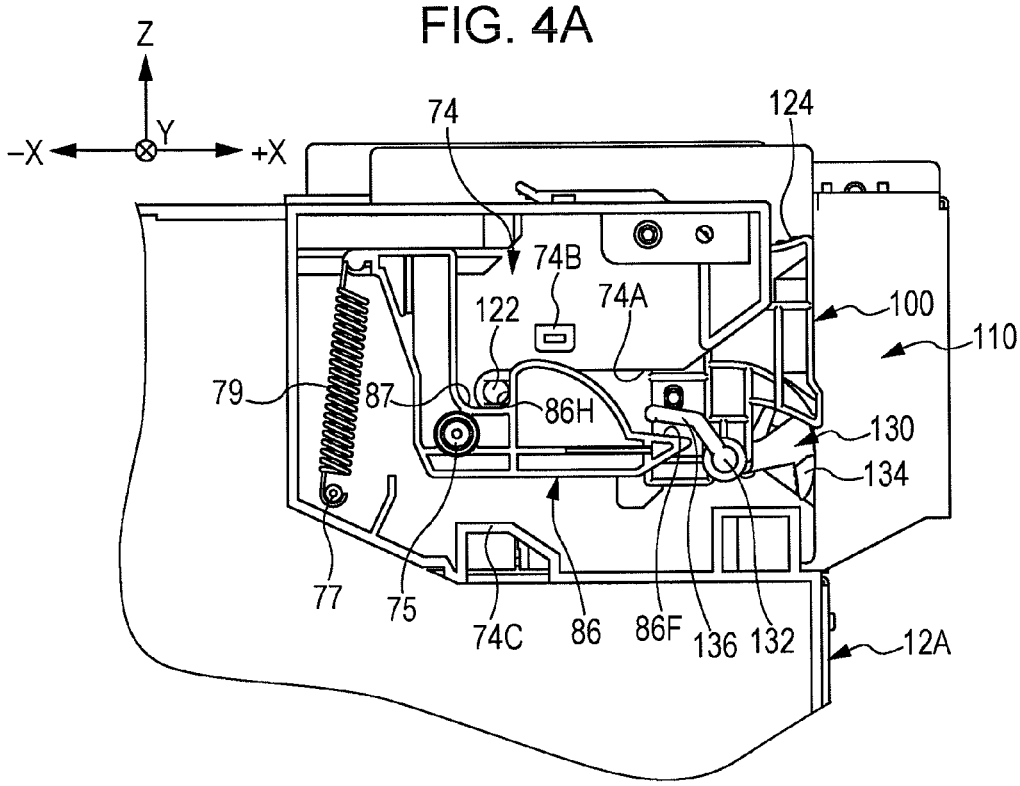
FIGS. 4A and 4B illustrate how a pressing member and a guide pin are disengaged by a release lever in the exemplary embodiment.

As illustrated in FIG. 4A, a cutout portion 74A is provided at a +X-direction end of the side plate 74 and at the center in the Z-direction. The longitudinal direction of the cutout portion 74A is the X-direction. The width of the cutout portion 74A in the Z-direction is set to receive and guide a below-described guide pin 122 provided as an example of an engaging portion in the fixing unit 100.

The side plate 74 also includes a columnar shaft portion 75 projecting outward (toward a front side of the drawing) in the Y-direction serving as the longitudinal direction, and a catch portion 77 projecting outward (toward the front side of the drawing) in the Y-direction at a position closer to the −X-direction side than the shaft portion 75. The catch portion 77 is formed by two columnar portions, and an outer one of the columnar portions has a large diameter for the purpose of fall prevention. The shaft portion 75 is provided with a turnable pressing member 86 that presses the guide pin 122 in the −X-direction.

One end of a tension spring 79 serving as an example of a biasing member is caught by a −X-direction end of the pressing member 86, and the other end of the tension spring 79 is caught by the catch portion 77. The side plate 74 further includes a first stopper portion 74B and a second stopper portion 74C formed by projections projecting in a direction opposite the Y-direction.

Figure 10A:
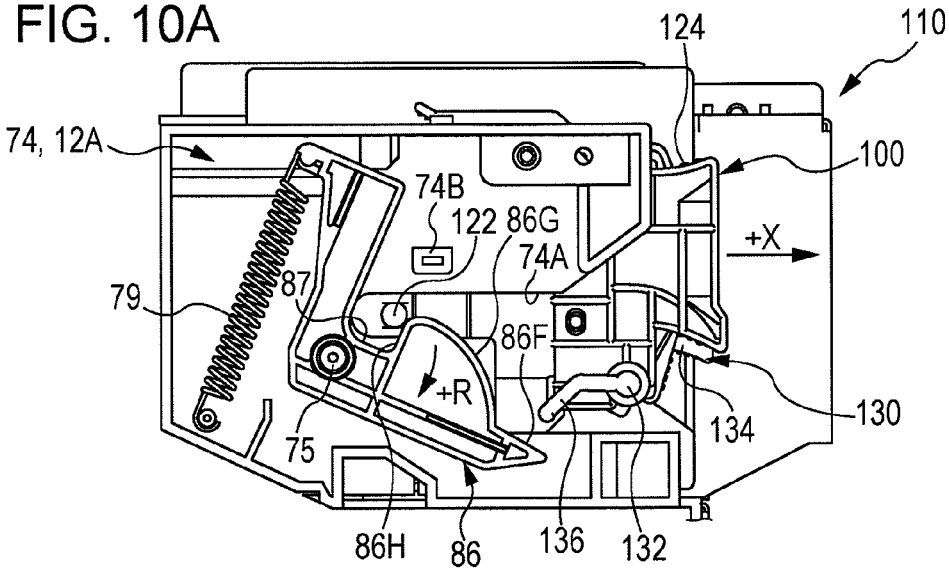
FIGS. 10A, 10B, and 10C illustrate how to dismount the fixing unit from the body section.
Figure 10B:
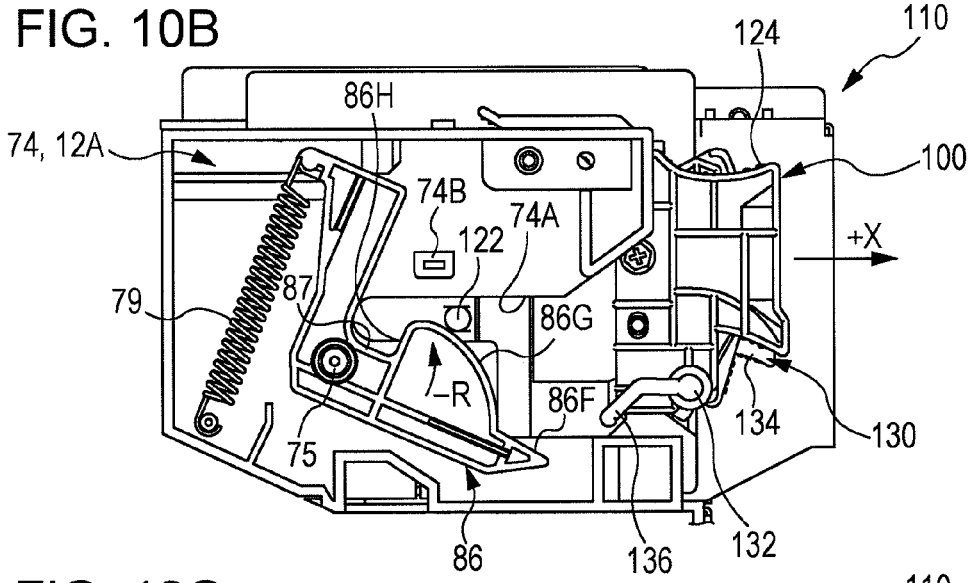
Figure 10C:
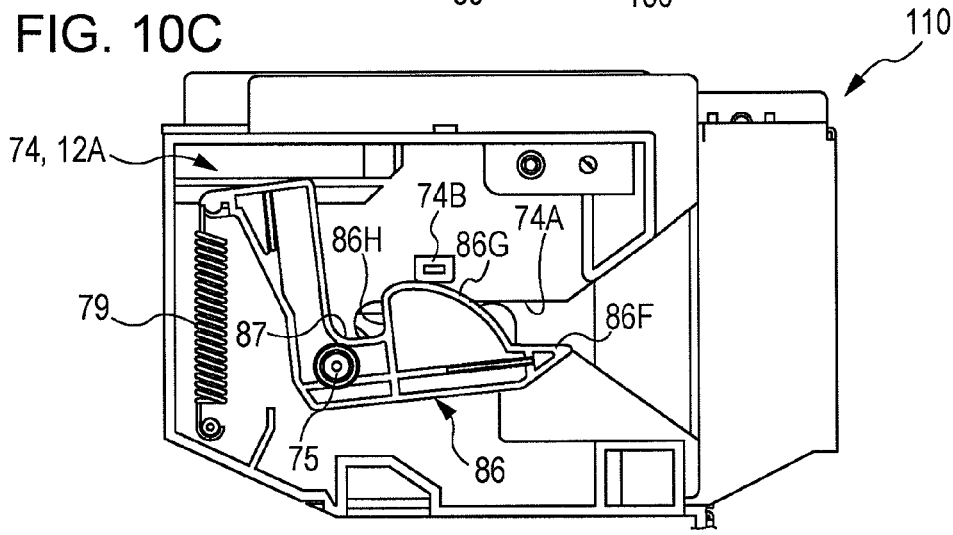

The first stopper portion 74B is located to restrict a moving range in which the pressing member 86 moves upward (in the Z-direction and counterclockwise direction in the figures) (see FIG. 10C). The second stopper portion 74C is located to restrict a moving range in which the pressing member 86 moves downward (in a direction opposite the Z-direction, and clockwise direction in the figures).

Figure 5A:
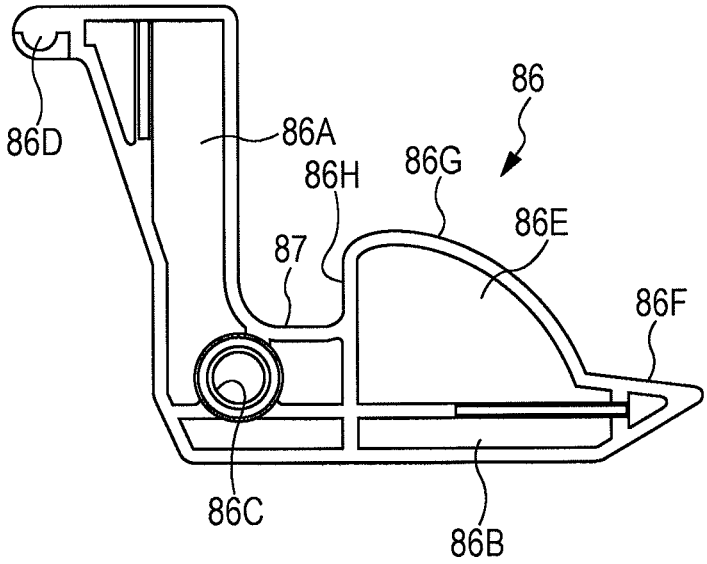
FIGS. 5A and 5B are a side view and a perspective view, respectively, of the pressing member.
Figure 5B:
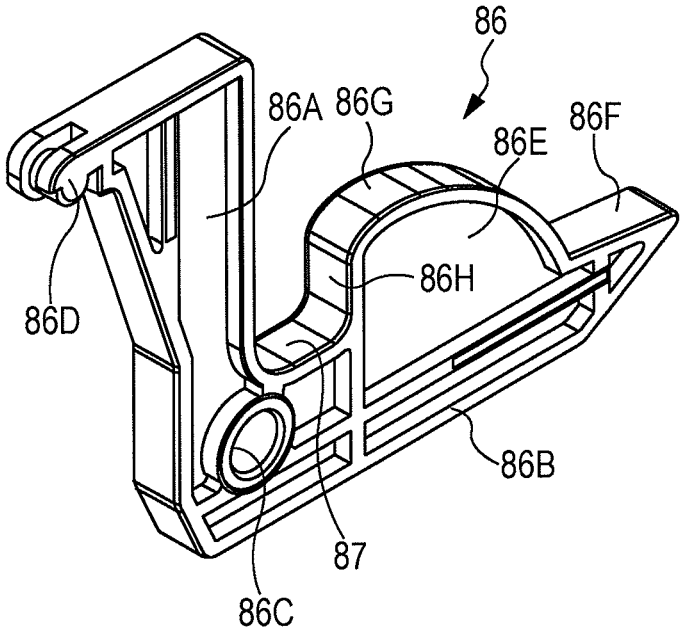

As illustrated in FIGS. 5A and 5B, the pressing member 86 is formed by a combination of platelike first and second arm portions 86A and 86B whose longitudinal directions are two orthogonal directions. A through-hole 86C in which the shaft portion 75 (see FIG. 4A) is to be inserted is provided in a portion where the first arm portion 86A and the second arm portion 86B are connected. In the pressing member 86, in a state in which the fixing unit 100 is mounted in the body section 12A, as illustrated in FIG. 4A, the first arm portion 86A is located in the Z-direction, and the second arm portion 86B is located in the +X-direction.

As illustrated in FIGS. 5A and 5B, an end of the first arm portion 86A (an end opposite the second arm portion 86B) has a catch portion 86D by which one end of the tension spring 79 (see FIG. 4A) is caught. At the center of the second arm portion 86B in the longitudinal direction, a latch portion 86E projects on the same side as the first arm portion 86A and in the longitudinal direction of the first arm portion 86A. An end of the second arm portion 86B (an end opposite the first arm portion 86A) has a contacted face 86F with which a below-described release lever 130 (see FIG. 6A) for releasing pressing of the pressing member 86 contacts.

The latch portion 86E bulges in an arc form (the form of a quarter of a circle) from a contacted face 86F side toward a through-hole 86C side of the second arm portion 86B, and includes a guide face 86G serving as a curved face to contact with the guide pin 122 (see FIG. 4A). At an end of the guide face 86G (a side opposite the contacted face 86F), a side face 86H is provided as a flat face substantially parallel to the first arm portion 86A. The side face 86H, an upper surface of the second arm portion 86B, and a side face of the first arm portion 86A define a recess 87.

As illustrated in FIG. 4A, the pressing member 86 is turnably mounted on the shaft portion 75 so as to move upward (in the Z-direction) to engage with the guide pin 122, and so as to move downward (in a direction opposite the Z-direction) to disengage from the guide pin 122.

Since the first arm portion 86A is pulled obliquely downward by the biasing force of the tension spring 79, a pressing force in the −X-direction acts on the guide pin 122 in a state in which the side face 86H of the pressing member 86 is in contact (engagement) with the guide pin 122.

In contrast, as illustrated in FIG. 3, a cutout portion 76A is provided at a +X-direction end of the side plate 76 and at the center in the Z-direction. The longitudinal direction of the cutout portion 76A is the −X-direction. The width of the cutout portion 76A in the Z-direction is such as to receive and guide a below-described guide pin 123 of the fixing unit 100.

A turnable pressing member 92 for pressing the guide pin 123 in the −X-direction is attached to the side plate 76. While the pressing member 92 is substantially similar in structure to the pressing member 86, it does not include the contacted face 86F (see FIG. 5A).

With this structure, when the fixing unit 100 (see FIG. 2A) is mounted in the body section 12A, the guide pin 123 passes over a latch portion of the pressing member 92 in the side plate 76 and engages with the pressing member 92. When the fixing unit 100 is dismounted from the body section 12A, the guide pin 123 passes over the latch portion of the pressing member 92 and disengages from the pressing member 92. That is, in the exemplary embodiment, a release operation using a release member is not performed in the side plate 76. Mounting and dismounting operations of the fixing unit 100 in the side plate 74 will be described in the following section "Operation."

Next, the fixing unit 100 will be described.

Figure 6A:
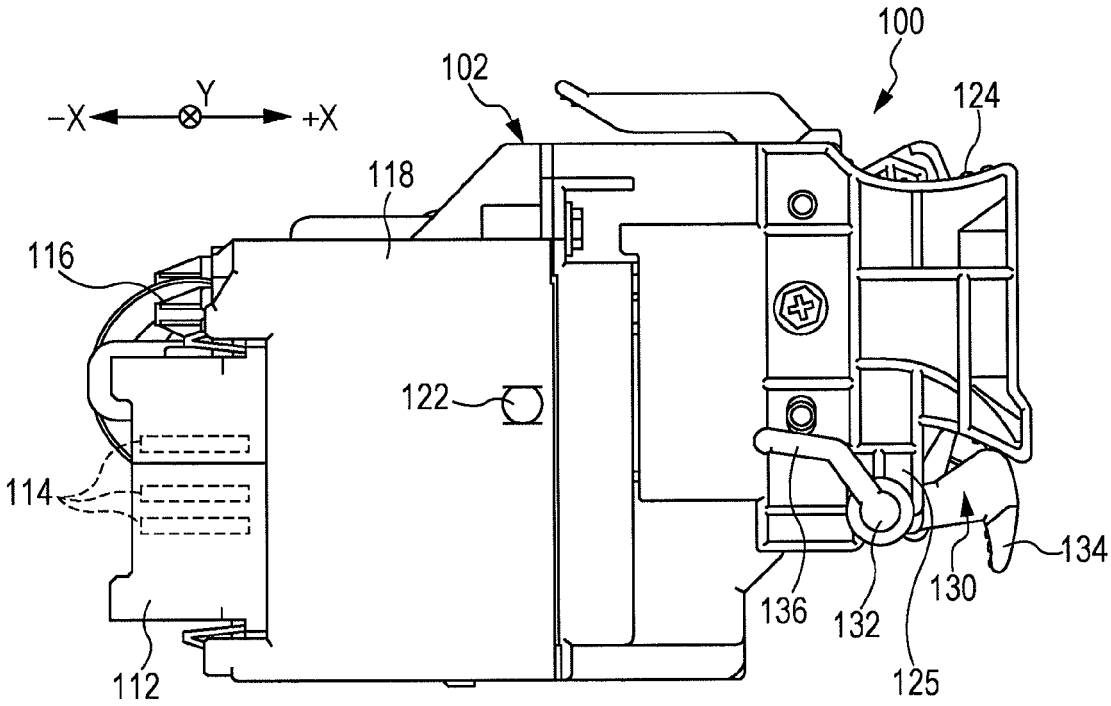
FIG. 6A is a side view of the fixing unit.

As illustrated in FIG. 6A, the fixing unit 100 has a housing 102 shaped like a rectangular parallelepiped. A connector portion 112 is provided as an example of a connecting portion at one end (front side) of the housing 102 in a longitudinal direction (Y-direction) intersecting the mounting direction (−X-direction) in which the fixing unit 100 is mounted in the body section 12A (see FIG. 2A).

The connector portion 112 is mechanically and electrically connectable to the connector 84 (see FIG. 2A), and includes power supply terminals 114 serving as an example of a power supply member that supplies electric power to a below-described halogen lamp 108 (see FIG. 6B). When the fixing unit 100 is mounted in the body section 12A (see FIG. 2A), the connector portion 112 is connected to the connector 84 in the −X-direction. In contrast, when the fixing unit 100 is dismounted from the body section 12A, the connector portion 112 is disconnected in the dismounting direction (+X-direction).

In a portion of the housing 102 adjacent to the connector portion 112, a columnar positioning pin 116 projects in the −X-direction. The positioning pin 116 has a size such as to be inserted in the positioning hole 82 (see FIG. 2B). Thus, when the fixing unit 100 is mounted in the body section 12A, the positioning pin 116 is inserted in the positioning hole 82, so that the fixing unit 100 is positioned.

Figure 7A:
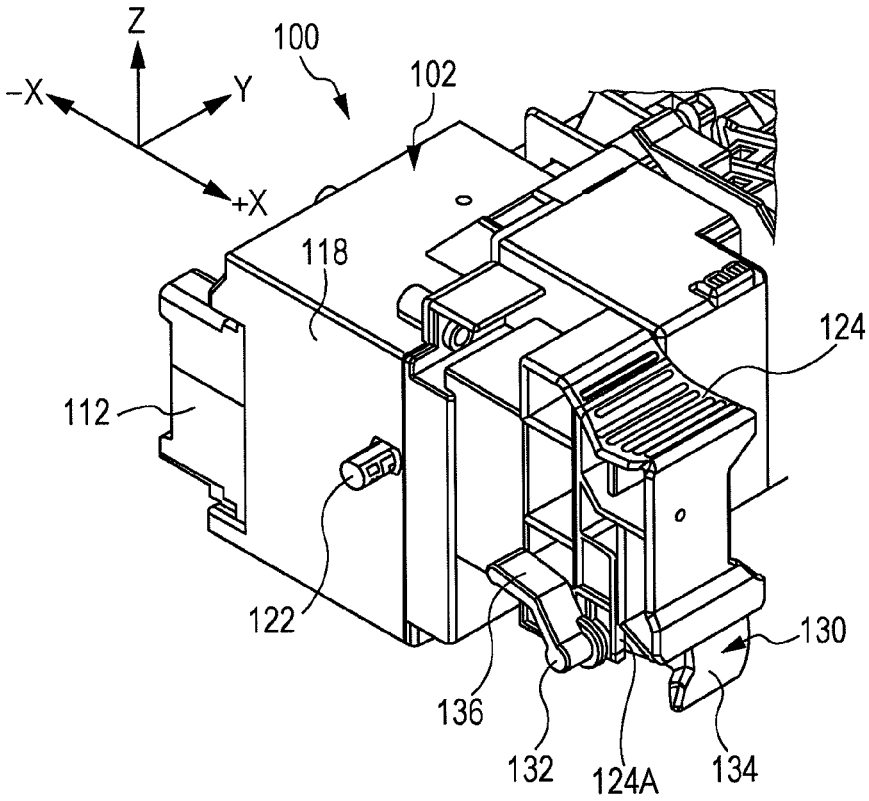
FIG. 7A is a perspective view of one end of the fixing unit.

As illustrated in FIG. 7A, a front side wall 118 of the housing 102 in the Y-direction is provided with a guide pin 122 serving as an example of an engaging portion. The longitudinal direction of the guide pin 122 is the Y-direction. Also, a front end in the Y-direction and on a +X-direction side of the housing 102 is provided with a grip portion 124 to be gripped by the user for mounting and dismounting of the fixing unit 100. On a lower side of the grip portion 124, a release lever 130 (described below) is provided as an example of a release member.

Figure 7B:
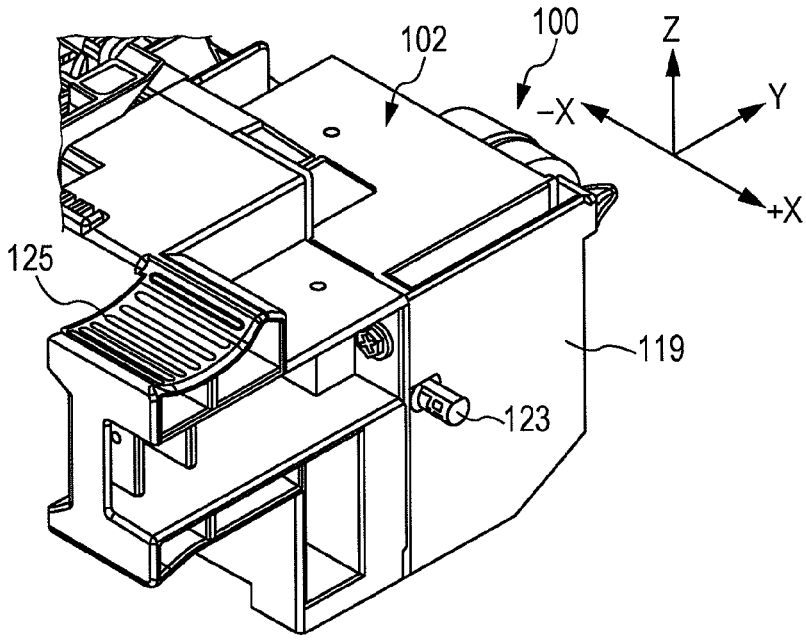
FIG. 7B is a perspective view of the other end of the fixing unit.

As illustrated in FIG. 7B, a rear side wall 119 of the housing 102 in the Y-direction is provided with a columnar guide pin 123 whose longitudinal direction is the Y-direction. At a rear end of the housing 102 in the Y-direction and on a +X-direction side, a grip portion 125 to be gripped by the user for mounting and dismounting of the fixing unit 100 is provided. In the exemplary embodiment, for example, the release lever 130 is not provided on the rear side in the Y-direction.

Figure 4B:
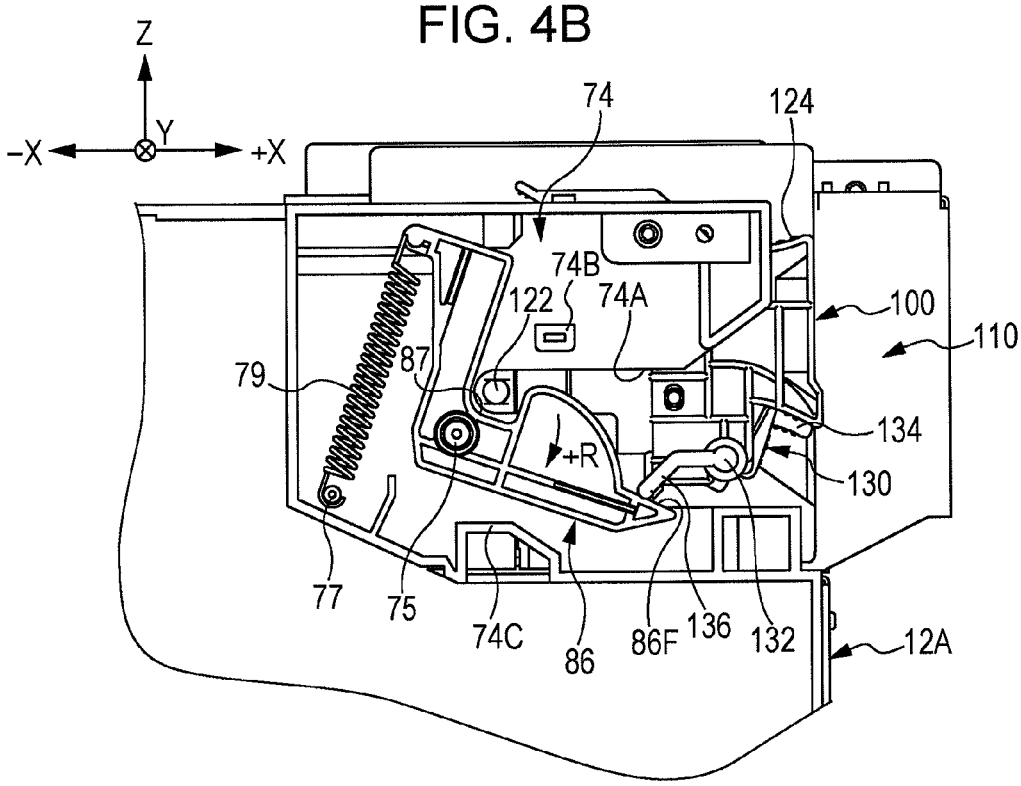
Figure 8A:
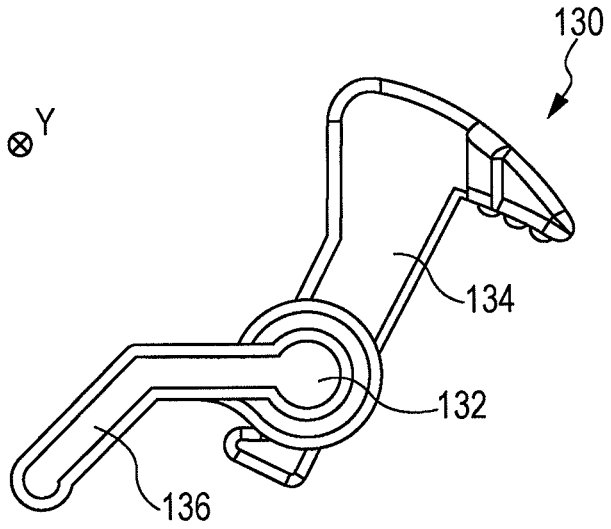
FIGS. 8A and 8B are a side view and a perspective view, respectively, of the release lever.
Figure 8B:
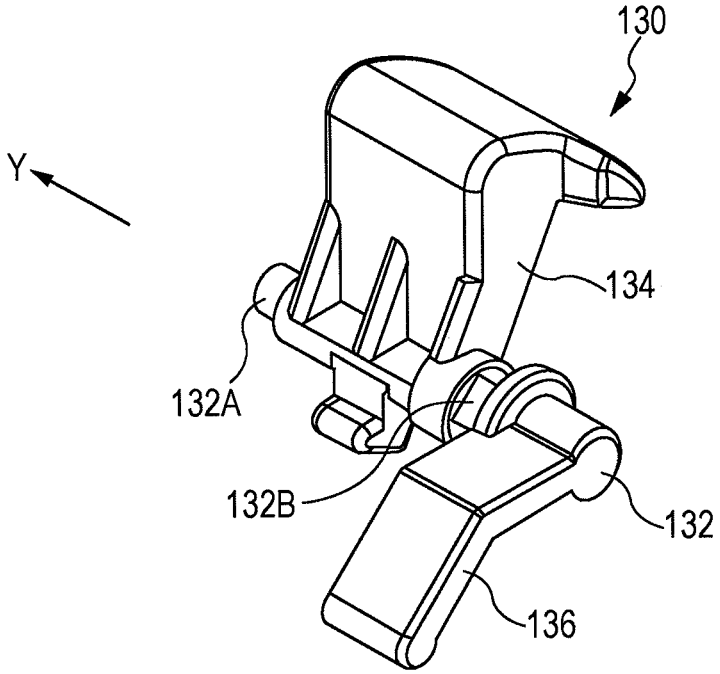

As illustrated in FIGS. 8A and 8B, the release lever 130 has a columnar shaft portion 132 whose axial direction is the Y-direction. A setting state of the release lever 130 illustrated in FIGS. 8A and 8B corresponds to a state in which pressing of the pressing member 86 is released by the release lever 130, as illustrated in FIG. 4B.

As illustrated in FIGS. 8A and 8B, an operating portion 134 is provided integrally with a rear portion of an outer peripheral surface of the shaft portion 132 in the Y-direction. The operating portion 134 extends obliquely upward and is bent obliquely downward at an end, as viewed in the Y-direction. Also, an acting portion 136 is provided integrally with a front portion of the outer peripheral surface of the shaft portion 132 in the Y-direction. The acting portion 136 extends in the −X-direction (see FIG. 4B) toward a side opposite the operating portion 134 and is bent obliquely downward at an end, as viewed in the Y-direction.

As illustrated in FIG. 8B, the outer peripheral surface of the shaft portion 132 is exposed in a rear end portion 132A of the shaft portion 132 in the Y-direction and in a gap portion 132B between the operating portion 134 and the acting portion 136. The end portion 132A and the gap portion 132B are turnably supported by a lower end portion 124A of the grip portion 124 in the housing 102 (see FIG. 7A).

When the fixing unit 100 is mounted in the body section 12A, as illustrated in FIG. 4A, the release lever 130 is set in a state in which a distal end of the acting portion 136 is located at a position shifted from the −X-direction side toward the Z-direction side (normal position).

In contrast, when the operating portion 134 is operated in a direction (Z-direction) different from the dismounting direction of the fixing unit 100 (+X-direction), as illustrated in FIG. 4B, the acting portion 136 of the release lever 130 comes into contact with the contacted face 86F of the pressing member 86 and moves the contacted face 86F downward. Thus, the release lever 130 moves the pressing member 86 against the biasing force (elastic force) of the tension spring 79 in a direction to release pressing against the guide pin 122 (a clockwise direction (+R-direction) centered on the shaft portion 75, as viewed in the Y-direction).

The mounting and dismounting mechanism 110 for the fixing unit 100 includes the fixing unit 100, the guide pin 122, the tension spring 79, the pressing member 86, and the release lever 130.

Figure 6B:
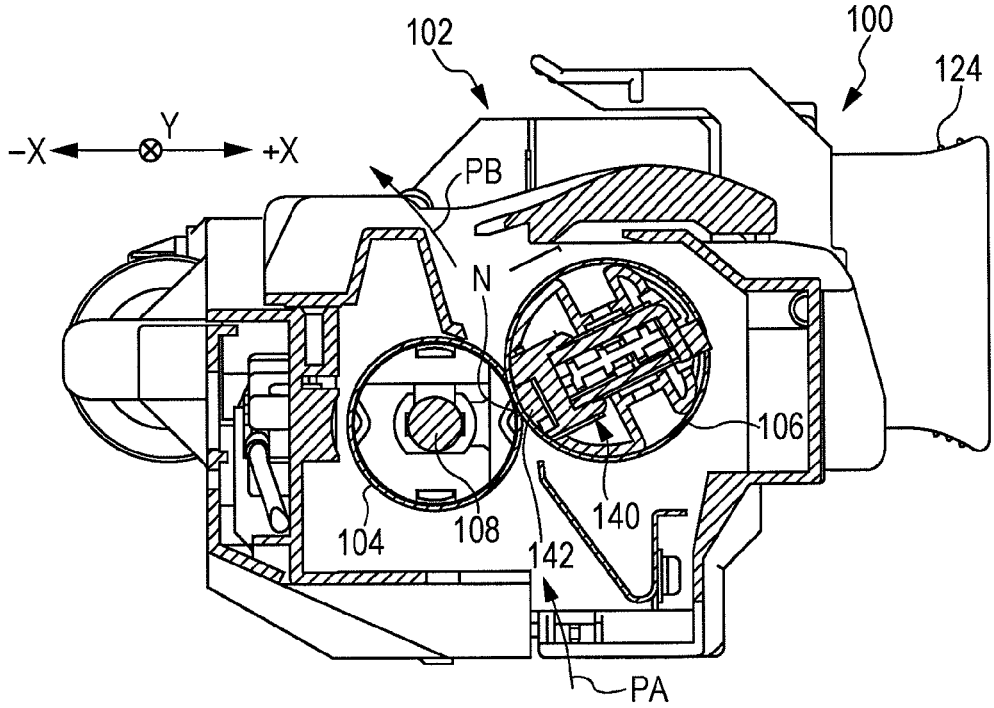
FIG. 6B illustrates an internal structure of the fixing unit.

As illustrated in FIG. 6B, the fixing unit 100 includes a heating roller 104 serving as an example of a heating rotating body, a pressurizing belt 106 serving as an example of a pressurizing rotating body, and a halogen lamp 108 serving as an example of a heat source fixed in the heating roller 104 at a distance from an inner peripheral surface of the heating roller 104. The fixing unit 100 also includes an unillustrated lever that releases pressing of the pressurizing belt 106 against the heating roller 104.

The heating roller 104 is a cylindrical member whose axial direction corresponds to a width direction of a recording sheet P (see FIG. 1) and the Y-direction serving as a main scanning direction of the exposure device 16 (see FIG. 1). The heating roller 104 is open at both ends in the Y-direction. For example, the heating roller 104 has a multilayered structure in which an elastic layer of silicone rubber and a release layer containing fluorine resin are stacked on an outer peripheral surface of a thin and cylindrical base material of steel.

The pressurizing belt 106 is an endless belt member whose axial direction corresponds to the Y-direction, and is open at both ends in the Y-direction. For example, the pressurizing belt 106 has a multilayered structure in which a release layer containing fluorine resin is provided on an outer peripheral surface of a thin and cylindrical base material of polyimide.

On an inner side of the pressurizing belt 106, a support unit 140 for supporting the pressurizing belt 106 rotatably and a pad member 142 attached to the support unit 140 are provided. The pad member 142 presses an outer peripheral surface of the pressurizing belt 106 against an outer peripheral surface of the heating roller 104. The pressurizing belt 106 and the heating roller 104 nip and pressurize a recording sheet P (not illustrated). A portion where the outer peripheral surface of the heating roller 104 and the outer peripheral surface of the pressurizing belt 106 are in contact with each other (to nip the recording sheet P) serves as a nip portion N. The recording sheet P is transported in a direction of arrow PA into the nip portion N, and is then transported (output) in a direction of arrow PB.

Operation

Next, the operation of the exemplary embodiment will be described.

First, a description will be given of how to mount the fixing unit 100 in the body section 12A.

Figure 9A:
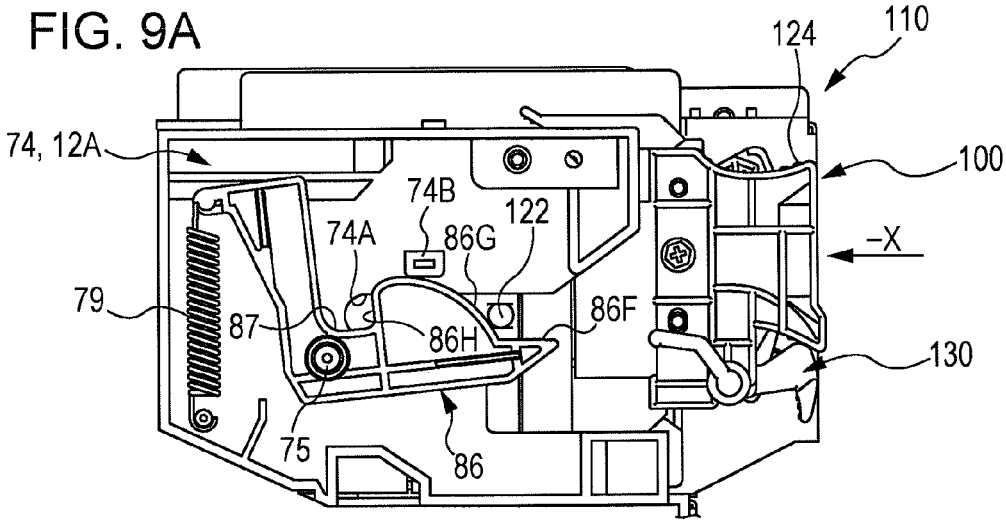
FIGS. 9A, 9B, and 9C illustrate how to mount the fixing unit in the body section.

When the fixing unit 100 is inserted in the body section 12A, as illustrated in FIG. 9A, the guide pin 122 enters the cutout portion 74A of the side plate 74 so as to guide the fixing unit 100 in the −X-direction. Then, the guide pin 122 comes into contact with the guide face 86G of the pressing member 86.

Figure 9B:
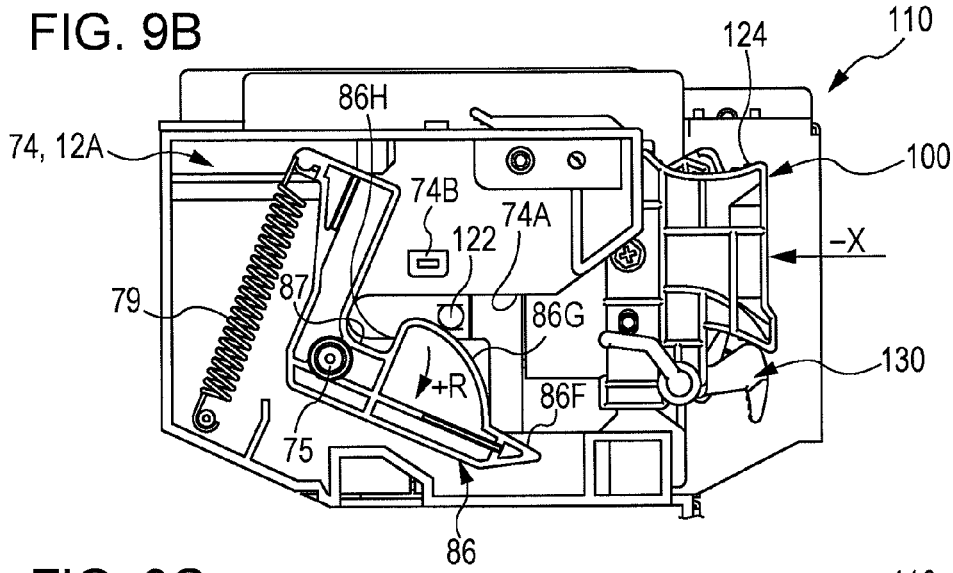

Subsequently, when the fixing unit 100 is pushed into the body section 12A (in the −X-direction), as illustrated in FIG. 9B, the guide pin 122 moving in the −X-direction pushes down the guide face 86G. Thus, the pressing member 86 is turned about the shaft portion 75 along the side plate 74 in the +R-direction (a clockwise and downward direction in the figure).

Figure 9C:
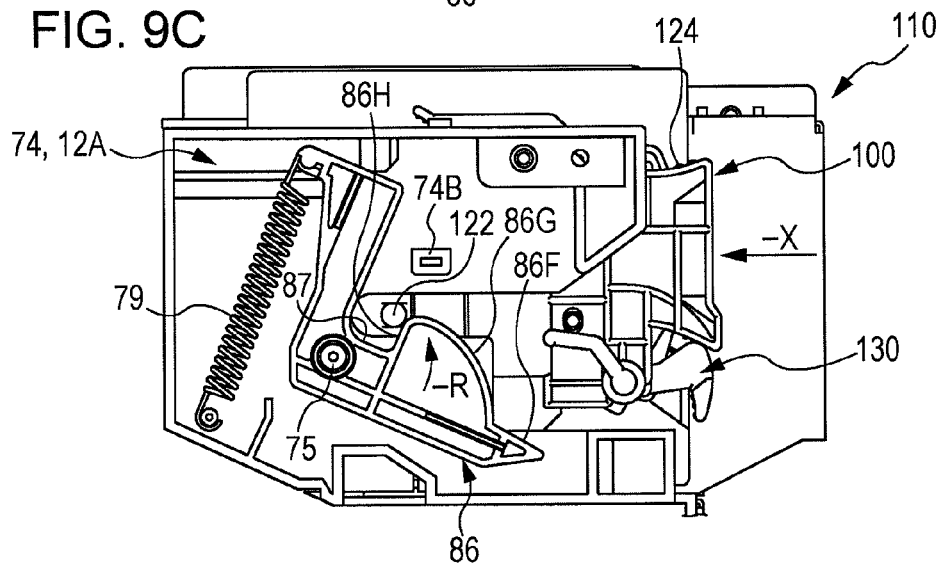

Next, when the fixing unit 100 is further pushed into the body section 12A (in the −X-direction), as illustrated in FIG. 9C, the guide pin 122 passes over an upper part of the guide face 86G, and the pressing member 86 moves in the −R-direction (a counterclockwise and upward direction in the figure). Thus, the guide pin 122 enters the recess 87 and engages with the side face 86H. Further, the biasing force of the tension spring 79 acts on the guide pin 122. In this way, the fixing unit 100 is pressed in the mounting direction (−X-direction) by the biasing force of the tension spring 79.

Since the fixing unit 100 is pressed in the mounting direction, the connector portion 112 of the fixing unit 100 is kept connected to the connector 84 of the body section 12A, as illustrated in FIGS. 2B and 6B. This allows power supply to the fixing unit 100.

Next, a description will be given of how to dismount the fixing unit 100 from the body section 12A.

As illustrated in FIG. 4B, when the grip portion 124 is gripped by the user, the operating portion 134 of the release lever 130 is also gripped, and is moved in the Z-direction. Thus, the release lever 130 is turned about the shaft portion 132 in the +R-direction, and the acting portion 136 comes into contact with the contacted face 86F of the pressing member 86. The release lever 130 moves the contacted face 86F downward against the biasing force of the tension spring 79. In this way, the guide pin 122 is disengaged from the side face 86H.

Subsequently, when the fixing unit 100 is pulled away from the body section 12A in the +X-direction in a state in which the release lever 130 is gripped, as illustrated in FIG. 10A, the guide pin 122 moving in the +X-direction comes into contact with the upper part of the guide face 86G. Then, the pressing member 86 is turned about the shaft portion 75 and parallel to the side plate 74 in the +R-direction.

In a moving stroke of the fixing unit 100 from the mounted position in the body section 12A to the position where the guide pin 122 comes into contact with the upper part of the guide face 86G, a strong connecting force (fitting force) acts between the connector portion 112 (see FIG. 6A) and the connector 84 (see FIG. 2B). Within this stroke, engaging force of the pressing member 86 is released.

Next, when the fixing unit 100 is pulled away in the dismounting direction (+X-direction), the connector portion 112 of the fixing unit 100 is disconnected from (comes out of contact with) the connector 84 of the body section 12A, as illustrated in FIGS. 2B and 6A.

While the acting portion 136 of the release lever 130 separates from the contacted face 86F of the pressing member 86, as illustrated in FIG. 10A, the guide pin 122 has already been placed on the guide face 86G. The connecting force between the connector portion 112 (see FIG. 6A) and the connector 84 (see FIG. 2B) does not act on the fixing unit 100. For these reasons, an operating force required in the dismounting direction of the fixing unit 100 is only a force by which the guide pin 122 passes over the guide face 86G against the biasing force of the tension spring 79.

Next, when the fixing unit 100 is further pulled away from the body section 12A in the +X-direction, as illustrated in FIG. 10B, the guide pin 122 passes over the upper part of the guide face 86G, and the pressing member 86 moves in the −R-direction.

Next, when the fixing unit 100 (see FIG. 10B) is entirely pulled out, as illustrated in FIG. 10C, the guide face 86G comes into contact with the first stopper portion 74B, and movement of the pressing member 86 is restricted.

As described above, when the fixing unit 100 is dismounted from the body section 12A in the mounting and dismounting mechanism 110 for the fixing unit 100 according to the exemplary embodiment, the operating force acts in the direction (Z-direction) different from the dismounting direction (+X-direction). Thus, the operating force required in the dismounting direction may be reduced, compared with a structure using the release member to be operated in the dismounting direction to dismount the fixing unit 100.

In the mounting and dismounting mechanism 110 for the fixing unit 100, the connector portion 112 and the release lever 130 are provided at one end (the same side) of the fixing unit 100 in the longitudinal direction (Y-direction). In a comparative example (not illustrated) in which the pressing member 86 is provided, but the release member 130 is not provided, the required operating force is the sum of an operating force required in the dismounting direction for disconnection of the connector portion 112 and the connector 84 and an operating force required in the dismounting direction for separation (disengagement) of the guide pin 122 from the pressing member 86.

In contrast, in the mounting and dismounting mechanism 110 for the fixing unit 100 according to the exemplary embodiment, an operating force is not required in the dismounting direction for separation (disengagement) of the guide pin 122 from the pressing member 86. Hence, only the operating force required in the dismounting direction for disconnection of the connector portion 112 and the connector 84 is applied. This may reduce the operating force required in the dismounting direction, compared with the comparative example.

In the mounting and dismounting mechanism 110 for the fixing unit 100, the pressing member 86 moves upward to engage with the guide pin 122, and moves downward to disengage from the guide pin 122. For this reason, when the fixing unit 100 is mounted in the body section 12A, a force in an upward direction (opposite the gravitational direction) acts on the fixing unit 100. Hence, a part of gravity acting on the fixing unit 100 is cancelled. This may reduce the frictional force (gravity×friction coefficient) acing on the fixing unit 100 during mounting in the body section.

In addition, in the mounting and dismounting mechanism 110 for the fixing unit 100, the connector portion 112 serves as an electrical connecting portion having the power supply terminals 114, and requires a strong connecting force to prevent conduction failure. When dismounting the fixing unit 100 from the body section 12A, an operating force that resists the strong connecting force is required. Since no operating force is required in the dismounting direction for separation (disengagement) of the guide pin 122 from the pressing member 86 in the mounting and dismounting mechanism 110, only the operating force required in the dismounting direction for disconnection of the connector portion 112 and the connector 84 is applied. This may reduce the operating force required in the dismounting direction.

Further, since the operating force required in the dismounting direction may be reduced in the mounting and dismounting mechanism 110 for the fixing unit 100, workability in mounting and dismounting of the fixing unit 100 may be enhanced.

In the release lever 130, the latch portion 86E is shaped like a quarter of a circle, and the side face 86H is formed as an upright wall. Hence, the pressing force of the side face 86H against the guide pin 122 acts without being reduced. Further, the side face 86H inhibits the guide pin 122 from coming out of the recess 87.

The present invention is not limited to the above-described exemplary embodiment.

Figure 11A:
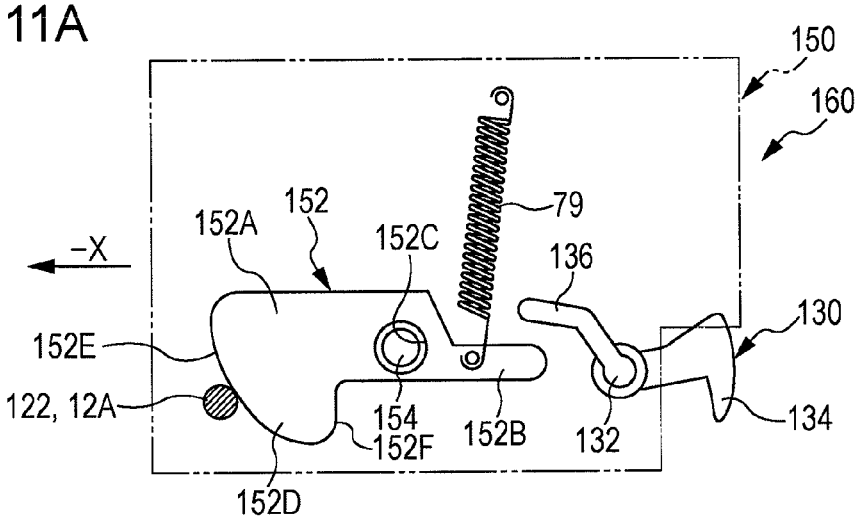
FIGS. 11A, 11B, and 11C illustrate how to dismount a fixing unit from a body section in a modification of the mounting and dismounting mechanism of the exemplary embodiment.

The pressing member may be provided in the fixing unit, not in the body section 12A (see FIG. 2A). FIG. 11A illustrates a mounting and dismounting mechanism 160 for a fixing unit 150 including a pressing member 152. Components having the same materials and structures as those adopted in the mounting and dismounting mechanism 110 for the fixing unit 100 are denoted by the same reference numerals, and descriptions thereof are skipped.

In the mounting and dismounting mechanism 160, a guide pin 122 is provided in a body section 12A. The fixing unit 150 includes a pressing member 152 that engages with the guide pin 122 and presses the fixing unit 150 in a mounting direction (−X-direction), a tension spring 79 that applies biasing force to the pressing member 152, and a release lever 130 that releases pressing of the pressing member 152.

The pressing member 152 is formed by a combination of a platelike first arm portion 152A whose longitudinal direction is the −X-direction and a platelike second arm portion 152B whose longitudinal direction is the +X-direction. In a portion where the first arm portion 152A and the second arm portion 152B are connected, a through-hole 152C is provided to receive a shaft portion 154 provided in the fixing unit 150.

One end of the tension spring 79 is caught by the center of the second arm portion 152B. An end of the first arm portion 152A in the longitudinal direction has a latch portion 152D projecting downward. The release lever 130 is to contact with an end of the second arm portion 152B.

The latch portion 152D bulges downward from the end of the first arm portion 152A in an arc form (in the form of a quarter of a circle), and includes a guide face 152E serving as a curved face for guiding the guide pin 122 and a side face 152F.

Figure 11B:
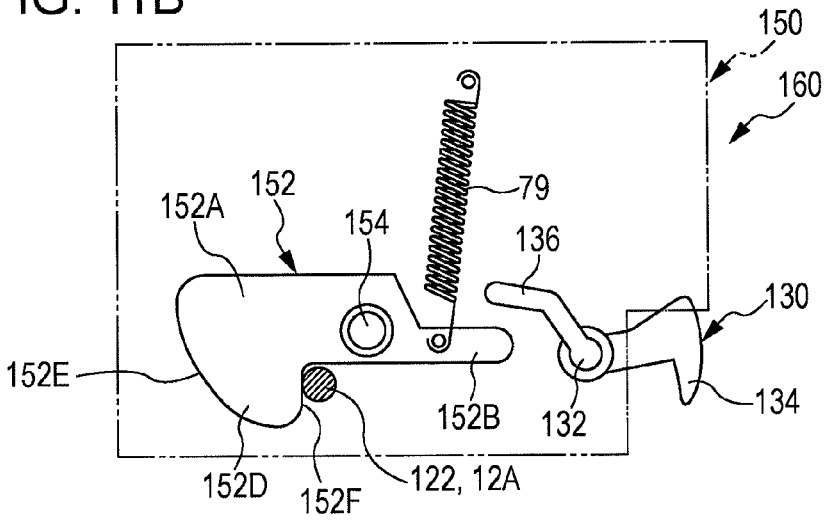

As illustrated in FIGS. 11A and 11B, when the fixing unit 150 is pushed into the body section 12A in the −X-direction for mounting, the first arm portion 152A of the pressing member 152 is turned upward by the contact between the guide pin 122 and the guide face 152E, and the guide pin 122 passes over the latch portion 152D. Then, the fixing unit 150 is mounted by the contact between the guide pin 122 and the side face 152F.

Figure 11C:
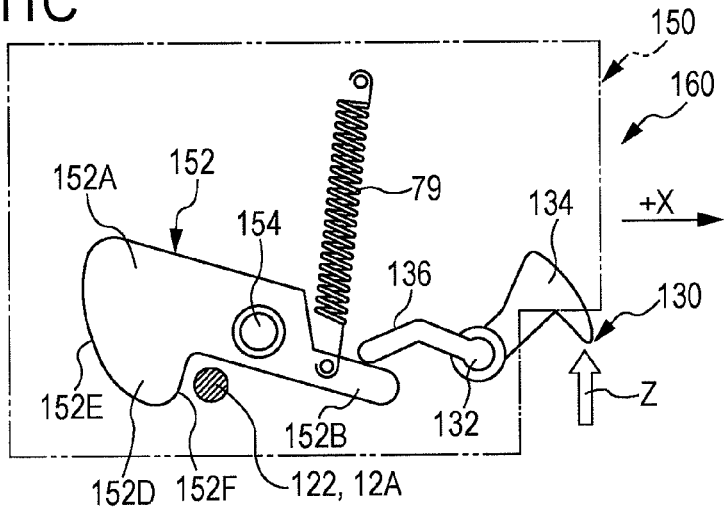

In contrast, when the release lever 130 is operated upward (in the Z-direction) to dismount the fixing unit 150 from the body section 12A, as illustrated in FIG. 11C, an acting portion 136 pushes down the second arm portion 152B, and the first arm portion 152A turns upward to separate the guide pin 122 and the side face 152F. When the fixing unit 150 is moved in the +X-direction in this state, the latch portion 152D moves over the guide pin 122, and dismounting of the fixing unit 150 is completed.

In this case in which the pressing member 152 is provided in the fixing unit 150, the operating force required in the dismounting direction of the fixing unit 150 may also be reduced by operating the release lever 130 in the direction different from the dismounting direction.

Instead of using the intermediate transfer belt 32, the transfer member may directly transfer a toner image from the photoconductor 22 onto a recording sheet P. Further, the fixing unit 100 may include a pressurizing roller instead of the pressurizing belt 106, and an electromagnetic induction heat source instead of the halogen lamp 108.

The mounting and dismounting mechanism 110 or 160 may be provided at both ends of the fixing unit 100 or 150 in the longitudinal direction.

The mounting and dismounting mechanism of the exemplary embodiment is applicable not only to the fixing unit 100 or 150, but also to any unit to be mounted in and dismounted from the body section 12A. Examples of units are the image forming units 20Y, 20M, 20C, and 20K and a toner cartridge.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A unit mounting and dismounting mechanism comprising:

a unit mountable in and dismountable from an apparatus body;

an engaging portion provided in one of the apparatus body and the unit;

a pressing member provided in the other of the apparatus body and the unit, the pressing member engaging with the engaging portion and pressing the unit against the apparatus body with a biasing force of a biasing member in a mounting direction of the unit when the unit is mounted in the apparatus body; and a release member provided in the unit, the release member being operated in a direction different from a dismounting direction of the unit from the apparatus body so as to move the pressing member against the biasing force of the biasing member in a direction to release pressing;

wherein a connecting portion that moves in the mounting direction to be connected to a connected portion provided in the apparatus body and moves in the dismounting direction to be disconnected from the connected portion is provided at one end of the unit in a longitudinal direction intersecting the mounting direction, and wherein the release member is provided at the one end in the longitudinal direction.

2. The unit mounting and dismounting mechanism according to claim 1, wherein the pressing member is provided in the apparatus body, and moves upward to engage with the engaging portion and moves downward to disengage from the engaging portion.

3. A unit mounting and dismounting mechanism comprising:

a unit mountable in and dismountable from an apparatus body;

un engaging portion provided in one of the apparatus body and the unit;

a pressing member provided in the other of the apparatus body and the unit, the pressing member engaging with the engaging portion and pressing the unit against the apparatus body with a biasing force of a biasing member in a mounting direction of the unit when the unit is mounted in the apparatus body;

a release member provided in the unit, the release member being operated in a direction different from a dismounting direction of the unit from the apparatus body so as to move the pressing member against the biasing force of the biasing member in a direction to release pressing;

wherein the pressing member is provided in the unit, and moves downward to engage with the engaging portion and moves upward to disengage from the engaging portion.

4. The unit mounting and dismounting mechanism according to claim 1, wherein the pressing member is provided in the unit, and moves downward to engage with the engaging portion and moves upward to disengage from the engaging portion.

5. A mounting and dismounting mechanism for a fixing unit, comprising:

the unit mounting and dismounting mechanism according to claim 1, wherein the unit is a fixing unit that fixes a developer image on a recording medium by melting the developer image with heat from a heat source, and wherein the connecting portion has a power supply member that supplies electric power to the heat source.

6. An image forming apparatus comprising:

a developer-image forming unit provided in an apparatus body to form a developer image;

a transfer unit provided in the apparatus body to transfer the developer image onto a recording medium; and a fixing unit including the unit mounting and dismounting mechanism according to claim 1, the fixing unit fixing the developer image transferred by the transfer unit onto the recording medium by melting the developer image.

7. An image forming apparatus comprising:

a developer-image forming unit provided in an apparatus body to form a developer image;

a transfer unit provided in the apparatus body to transfer the developer image onto a recording medium; and a fixing unit including the unit mounting and dismounting mechanism according to claim 2, the fixing unit fixing the developer image transferred by the transfer unit onto the recording medium by melting the developer image.

8. An image forming apparatus comprising:

a developer-image forming unit provided in an apparatus body to form a developer image;

a transfer unit provided in the apparatus body to transfer the developer image onto a recording medium; and a fixing unit including the mounting and dismounting mechanism for the fixing unit according to claim 5.

* * * * *